US009389549B2

(12) United States Patent
Miyamae

(10) Patent No.: US 9,389,549 B2
(45) Date of Patent: Jul. 12, 2016

(54) IMAGE FORMING APPARATUS

(71) Applicant: KYOCERA Document Solutions Inc., Osaka-shi, Osaka (JP)

(72) Inventor: Tsubasa Miyamae, Osaka (JP)

(73) Assignee: KYOCERA DOCUMENT SOLUTIONS INC., Osaka-shi, Osaka (JP)

( * ) Notice: Subject to any disclaimer, the term of this patent is extended or adjusted under 35 U.S.C. 154(b) by 0 days.

(21) Appl. No.: 14/748,259

(22) Filed: Jun. 24, 2015

(65) Prior Publication Data

US 2015/0378295 A1 Dec. 31, 2015

(30) Foreign Application Priority Data

Jun. 30, 2014 (JP) ..... 2014-133586

(51) Int. Cl.
*G03G 15/20* (2006.01)
*G03G 15/23* (2006.01)
*G03G 15/00* (2006.01)

(52) U.S. Cl.
CPC ..... *G03G 15/2014* (2013.01); *G03G 15/234* (2013.01); *G03G 15/5062* (2013.01); *G03G 15/55* (2013.01); *G03G 2215/00569* (2013.01)

(58) Field of Classification Search
CPC combination set(s) only.
See application file for complete search history.

(56) References Cited

U.S. PATENT DOCUMENTS

2004/0005159 A1* 1/2004 Ito et al. ..... G03G 15/55 399/50
2006/0115288 A1* 6/2006 Roof ..... G03G 15/2003 399/67
2011/0058823 A1* 3/2011 Hirai ..... G03G 15/0131 399/15

FOREIGN PATENT DOCUMENTS

JP 2000347537 A 12/2000

* cited by examiner

*Primary Examiner* — Clayton E Laballe
*Assistant Examiner* — Jas Sanghera

(57) ABSTRACT

An image forming apparatus has a patch forming unit, a reversing unit, a patch detecting unit, and a fixing condition correcting unit. The patch forming unit forms a patch for fixability test on conveyed paper by a fixing roller having a fixing condition set corresponding to the execution of a print job. The reversing unit reverses the paper on which the patch for fixability test is formed from the front surface to the back surface through a reversing and conveying path. The patch forming unit detects a characteristic value of the patch for fixability test of the reversed paper using a medium sensor which detects the characteristic value of the back surface of the paper. The fixing condition correcting unit corrects the fixing condition based on the detected characteristic value of the patch for fixability test.

7 Claims, 7 Drawing Sheets

<GOOD FIXATION SURFACE PHOTOGRAPH>

<POOR FIXATION SURFACE PHOTOGRAPH>

FIG.8

801 802 803 800

| FREQUENCY | MINUTE CONVEYANCE DISTANCE | RANGE |
|---|---|---|
| ONE TIME | 2mm | 10mm (FIVE TIMES) |
| TWO TIMES | 1mm | 5mm (FIVE TIMES) |

IMAGE FORMING APPARATUS

INCORPORATION BY REFERENCE

The disclosure of Japanese Patent Application No. 2014-133586 filed on Jun. 30, 2014 including the specification, drawings and abstract is incorporated herein by reference in its entirety.

BACKGROUND

The present disclosure relates to an image forming apparatus and an image forming method.

Heretofore, an image forming apparatus, such as a multifunctional peripheral, a copying machine, and a printer, has various techniques of correcting the fixing temperature of a fixing unit which fixes a toner image to paper. As a former case, an image forming apparatus is known which corrects the fixing temperature by measuring the toner amount of a toner image fixed to paper using a light emitting element and a light receiving element provided on the downstream side of a fixing unit. Thus, a fixed image in which a good image state is secured can be stably obtained and situations, such as useless recopying and the use of an OHP sheet with a bad appearance, can also be avoided.

SUMMARY

An image forming apparatus according to an aspect of the present disclosure has a patch forming unit, a reversing unit, a patch detecting unit, and a fixing condition correcting unit. The patch forming unit forms a patch for fixability test on conveyed paper by a fixing roller having a fixing condition set corresponding to the execution of a print job. The reversing unit reverses the paper on which the patch for fixability test is formed from the front surface to the back surface, and then re-conveys the reversed paper through a reversing and conveying path. The patch forming unit detects a characteristic value of the patch for fixability test of the reversed paper using a medium sensor which detects the characteristic value of the back surface of the paper. The fixing condition correcting unit corrects the fixing condition based on the detected characteristic value of the patch for fixability test.

BRIEF DESCRIPTION OF THE DRAWINGS

FIG. 8 is a view illustrating an example of a minute conveyance distance table in the third embodiment of the present disclosure.

DETAILED DESCRIPTION

Hereinafter, embodiments of the present disclosure are described with reference to the accompanying drawings and the description is presented for understanding of the present disclosure. The following embodiments are specific examples of the present disclosure and do not limit the technical scope of the present disclosure. The alphabet "S" attached to the number in the flowchart means "Step".

Hereinafter, an image forming apparatus is described as an example of the embodiment of the present disclosure. The image forming apparatus of the present disclosure is equivalent to a multifunctional peripheral (MFP) having functions of a copier, a scanner, a printer, and the like, for example.

Figure 1:
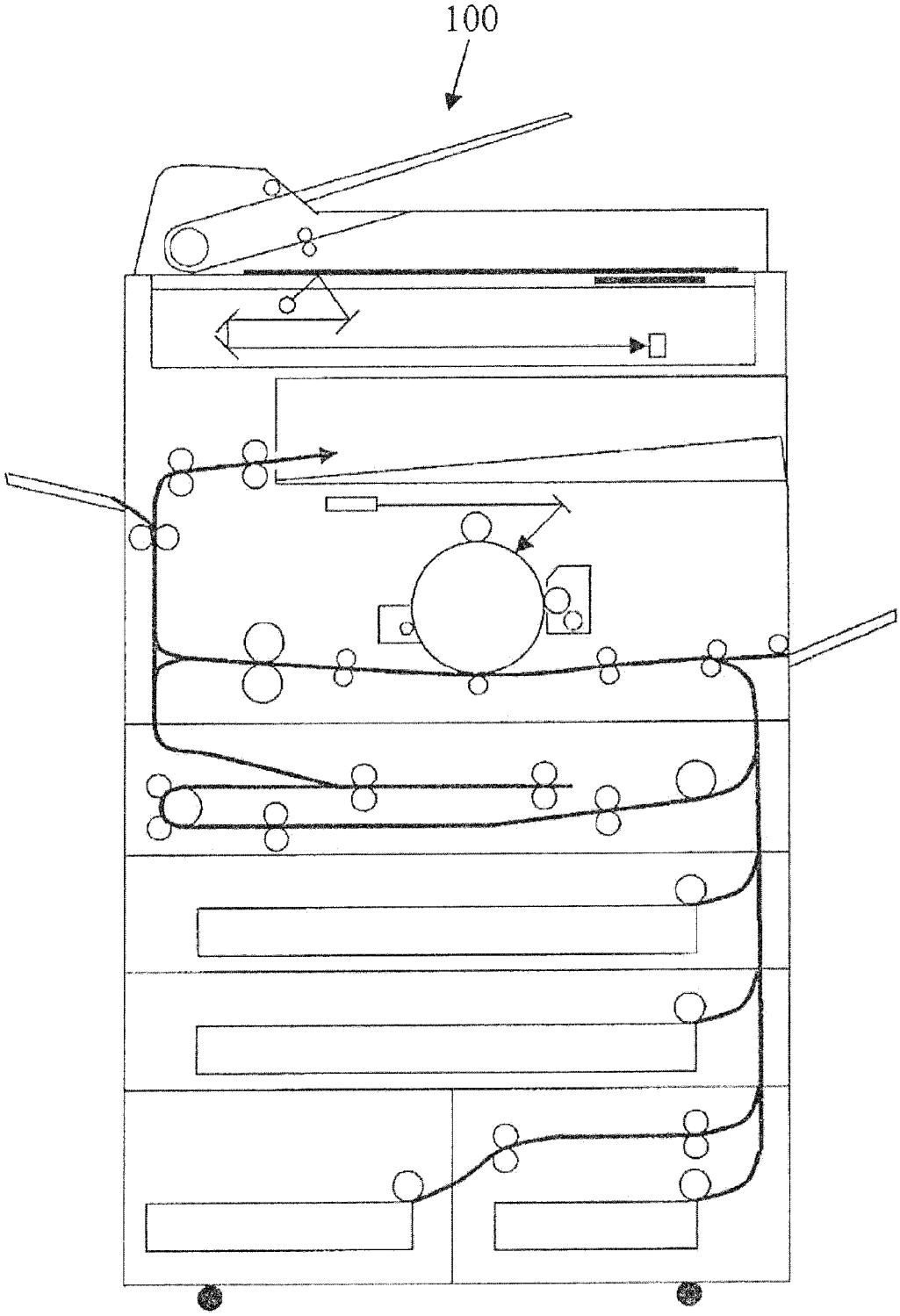
FIG. 1 is a diagram illustrating the entire internal configuration of a multifunctional peripheral according to the present disclosure.

As illustrated in FIG. 1, a multifunctional peripheral 100 receives a setting condition of a print job from a user through an operating unit, drives each unit (an image reading unit, an image forming unit, a paper conveying unit, a fixing unit, a reversing unit, and the like), and then provides the print job.

The image reading unit reads image data of a document on a document table and the paper conveying unit conveys paper of the type corresponding to the setting condition. The image forming unit transfers a toner image corresponding to the image data to the paper and the fixing unit fixes the toner image to the paper. The paper to which the toner image is fixed is discharged as printed matter. The reversing unit reverses the paper from the front surface to the back surface according to the setting condition, and then conveys the reversed paper to the paper conveying unit.

Figure 2:
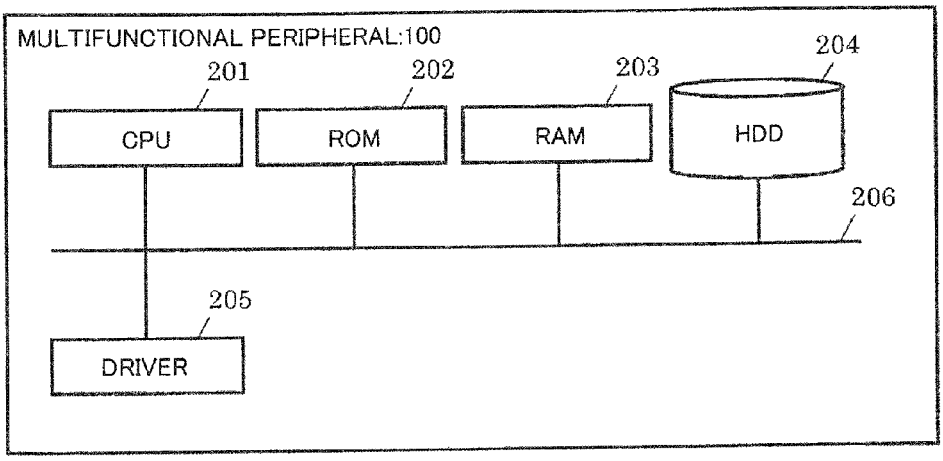
FIG. 2 is a view illustrating the configuration of a control system hardware of a multifunctional peripheral according to the present disclosure.

As illustrated in FIG. 2, in a control circuit of the multifunctional peripheral 100, a CPU (Central Processing Unit) 201, a ROM (Read Only Memory) 202, a RAM (Random Access Memory) 203, a HDD (Hard Disk Drive) 204, and a driver 205 corresponding to each actuator are connected through an internal bus 206.

The CPU of the multifunctional peripheral 100 utilizes, for example, the RAM as a working space, executes programs stored in the ROM, the HDD, and the like, transmits and receives data, directions, signals, commands, and the like from the driver and the image reading unit 101 based on the execution results, and then controls an operation of each actuator illustrated in FIG. 1. Also in each unit (illustrated in FIG. 3) described later other than the actuators, the CPU realizes each unit by executing each program. The ROM, the RAM, and the HDD store programs and data which realize each unit described below.

First Embodiment

Figure 3:
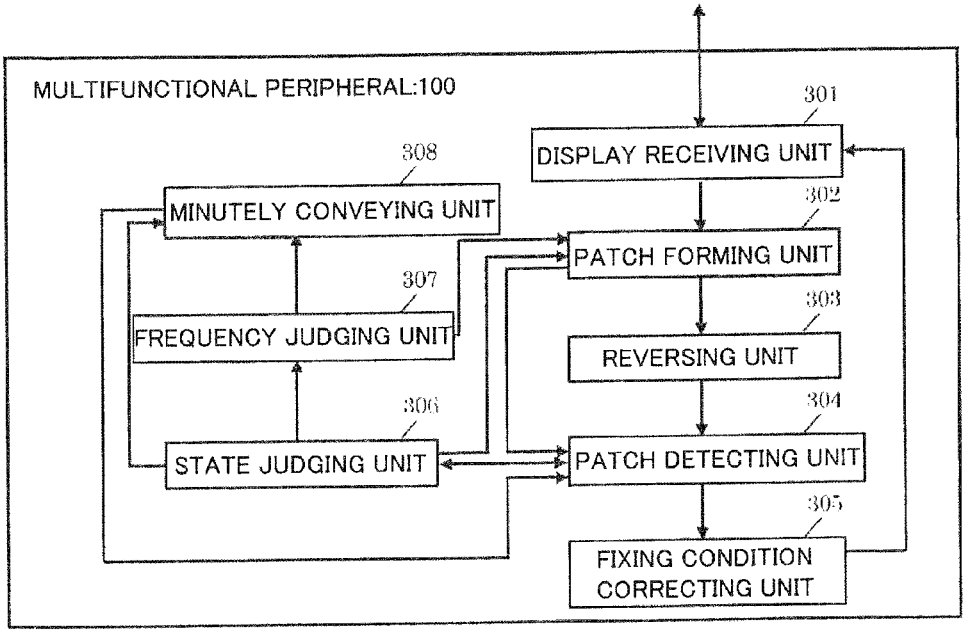
FIG. 3 is a functional block diagram of a multifunctional peripheral in a first embodiment of the present disclosure.

Next, the configuration and the execution procedure according to the first embodiment of the present disclosure are described with reference to FIG. 3 and FIG. 4. First, when a user turns ON the power supply of the multifunctional peripheral 100, a display receiving unit 301 of the multifunctional peripheral 100 displays an operation screen on a touch panel of the operating unit, and then starts the receiving of a print job. When the user selects a fixability test key for carrying out a fixability test while looking at the operation screen, the display receiving unit 301 receives the selection of the fixability test key, and then notifies the reception to a patch forming unit 302. The patch forming unit 302 which receives the notice starts the fixability test, and then heats a fixing roller under the fixing condition set corresponding to the execution of the print job (FIG. 4: S101). Herein, the fixing condition means the fixing temperature to be used in the execution of a usual print job, for example.

Figure 4:
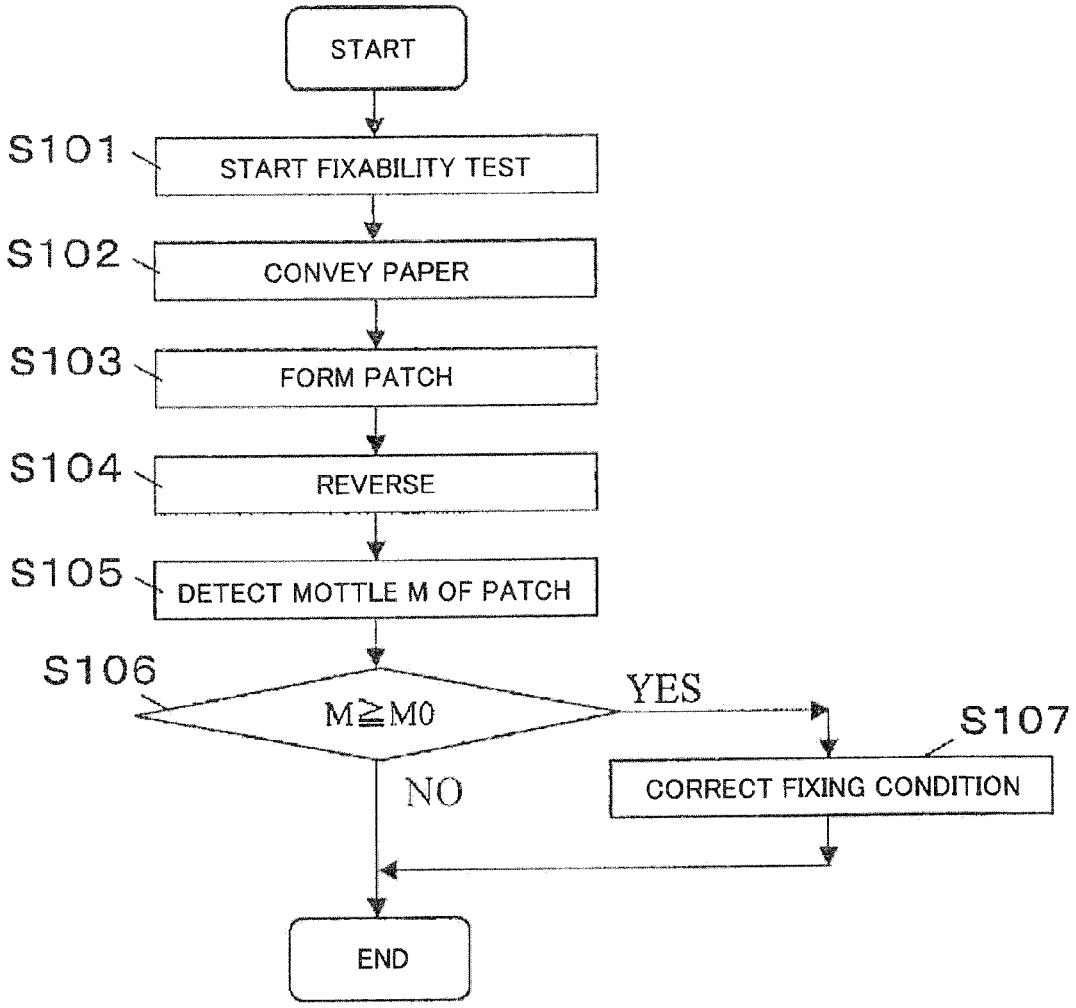
FIG. 4 is a flowchart for showing an execution procedure of the first embodiment of the present disclosure to be shown.

When the patch forming unit 302 starts the heating of the fixing roller, paper is further conveyed from a predetermined paper feeding cassette (FIG. 4: S102), and then a patch for fixability test is formed on the conveyed paper by the fixing roller having a condition set to the fixing condition (FIG. 4: S103).

Figure 5A:
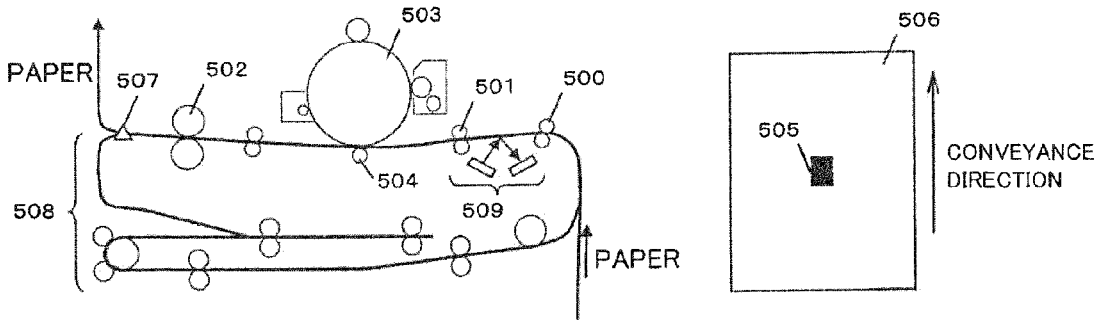
FIG. 5A are views illustrating the relationship among a medium sensor, a photoconductor drum, a fixing roller, and a reversing and conveying path and an example of a patch for fixability test in the first embodiment of the present disclosure.

Herein, a method for forming the patch by the patch forming unit 302 is not particularly limited. For example, as illustrated in FIG. 5A, the paper to be conveyed from the paper feeding cassette passes through a conveyance roller 500, the conveyance of the paper is temporarily stopped by a resist roller 501, and then the bias is corrected. Herein, in the case where the fixing roller 502 located on the downstream side relative to the resist roller 501 is being heated, the patch forming unit 302 stops the conveyance of the paper by the resist roller 501 until the condition of the fixing roller 502 is set to the fixing condition. Then, when the condition of the fixing roller 502 is set to the fixing condition, the patch forming unit 302 forms a toner image corresponding to the patch for fixability test on a photoconductor drum 503 located on the downstream side relative to the resist roller 501 and on the upstream side relative to the fixing roller 502, conveys the paper from the resist roller 501 at predetermined timing, and then lets the paper pass between the photoconductor drum 503 and a transfer roller 504 and also transfers the patch for fixability test on the photoconductor drum 503 thereto. Herein, the patch for fixability test is a patch 505 having an approximately 1 cm-square shape as illustrated in FIG. 5A, and one patch is transferred to a position (for example, center of the paper 506) where a medium sensor described later can detect the characteristic value of the patch 505 when the paper 506 is stopped by the resist roller 501.

Then, the patch forming unit 302 lets paper 506 to which the patch 505 for fixability test is transferred pass through the fixing roller 502, and then fixes the patch 505 for fixability test to the paper 506. Thus, the patch 505 for fixability test can be formed.

When the patch forming unit 302 completes the formation, the completion of the formation of the patch is notified to the reversing unit 303. Then, the reversing unit 303 which receives the notice reverses the paper 506 on which the patch 505 for fixability test is formed from the front surface to the back surface, and then re-conveys the reversed paper through the reversing and conveying path (FIG. 4: S104).

A reversing method by the reversing unit 303 is not particularly limited. For example, as illustrated in FIG. 5A, a turning point 507 located on the downstream side relative to the fixing roller 502 is started to guide the paper 506 on which the patch 505 for fixability test is formed to the reversing and conveying path 508, and then the paper 506 on which the patch 505 for fixability test is formed is reversed from the front surface to the back surface through the reversing and conveying path 508. Then, the reversing unit 303 returns the reversed paper 506 to a paper conveying path at a position on the upstream side relative to the resist roller 501.

Then, when the reversing unit 303 completes the reversal, the completion of the reversal is notified to the patch detecting unit 304, and then the patch detecting unit 304 which receives the notice detects the characteristic value of the patch 505 for fixability test of the reversed paper 506 using the medium sensor which detects the characteristic value of the back surface of the paper (FIG. 4: S105).

A detection method by the patch detecting unit 304 is not particularly limited. For example, as illustrated in FIG. 5A, a medium sensor 509 capable of detecting the characteristic value (for example, Mottle) of the back surface of the paper is provided beforehand between the conveyance roller 500 and the resist roller 501. This medium sensor 509 is disposed at a position facing the photoconductor drum 503 through the paper conveying path. The patch detecting unit 304 temporarily stops the conveyance of the reversed paper 506 by the resist roller 501 and also starts the medium sensor 509 to acquire the Mottle of the patch 505 for fixability test on the back surface of the paper 506.

Then, when the patch detecting unit 304 completes the detection, the resist roller 501 is driven to re-start the conveyance of the paper of the patch 505 for fixability test, the paper is discharged, and then the discharge of the paper is notified to the fixing condition correcting unit 305. The fixing condition correcting unit 305 which receives the notice corrects the fixing condition based on the detected characteristic value of the patch 505 for fixability test.

A correction method by the fixing condition correcting unit 305 is not particularly limited. For example, when the characteristic value of the patch 505 for fixability test is the reflectivity, the fixing condition correcting unit 305 judges whether or not the detected Mottle M of the patch 505 for fixability test detected is equal to or less than a present threshold value M0 (FIG. 4: S106).

Figure 5B:
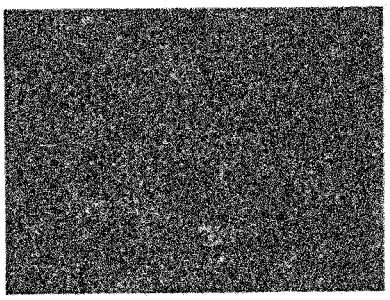
FIG. 5B are photographs showing an example of a good fixation surface photograph and a poor fixation surface photograph.
Figure 5B:
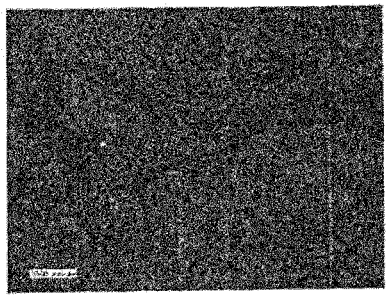

When the detected Mottle M of the patch 505 for fixability test exceeds the threshold value M0 as a result of the judgment (FIG. 4: S106 NO), the result shows that the fixing of the toner image is good and the patch 505 for fixability test is smooth and sufficiently reflects as illustrated in FIG. 5B. Therefore, the fixing condition correcting unit 305 judges that there is no necessity of correcting the fixing condition, and then notices the judgment result to the display receiving unit 301. The display receiving unit 301 which receives the notice displays a screen which shows that the fixing condition is normal and the fixability test is completed through a touch panel, and then the processing is completed.

On the other hand, when the detected Mottle M of the patch 505 for fixability test is equal to or less than the threshold value M0 (FIG. 4: S106 YES) as a result of the judgment in S106, the result shows that the fixing of the toner image is poor and the patch 505 for fixability test is rough, has irregularities within 5 μm, and is hard to reflect as illustrated in FIG. 5B. Therefore, the fixing condition correcting unit 305 judges that there is a necessity of correcting the fixing condition, and then corrects the fixing condition (FIG. 4: S107). Herein, a correction method by the fixing condition correcting unit 305 is not particularly limited and, for example, a method including adding a preset value to the fixing temperature of the fixing condition to increase the fixing temperature, a method including adding a preset value to the nip pressure of the fixing condition to increase the nip pressure, and the like can be mentioned. Thus, the characteristic value of the patch 505 for fixability test can be fed back to the fixing condition, whereby good fixability can be maintained. According to the type of the characteristic values (for example, reflectivity, transmittance, and the like) of the patch 505 for fixability test, the correction method of the fixing condition is changed as appropriate.

Then, when the fixing condition correcting unit 305 completes the correction, the completion of the correction is notified to the display receiving unit 301. Then, the display receiving unit 301 which receives the notice displays a screen which shows that the fixability test is completed, and then the processing is completed.

In the description above, the fixability test is carried out using the paper drawn out of one paper feeding cassette.

However, when a plurality of paper feeding cassettes are provided in the multifunctional peripheral 100, paper may be drawn out of each paper feeding cassette, and then the fixability test described above may be carried out.

In the description above, although it is configured so that the patch 505 for fixability test is immediately formed on the front surface of the paper, and then the characteristic value of the patch 505 for fixability test is detected, other configurations may be acceptable. For example, blank paper is made to pass through the reversing and conveying path 508 without the formation of the patch for fixability test, and then the medium sensor 509 first detects the characteristic value of the paper (back surface) of the blank paper. The characteristic value of the blank paper is acquired as a background value. Next, the blank paper is further made to pass through the reversing and conveying path 508 to reverse the blank paper, the background value of which is acquired. Then, the patch for fixability test is formed on the reversed blank paper, and then made to pass through the reversing and conveying path 508 again. Then, the medium sensor 509 detects the characteristic value of the patch for fixability test. Then, a calculated value obtained by correcting the characteristic value of the patch for fixability test based on the background value is used for the correction of the fixing condition. Thus, the fixability of the patch for fixability test can be correctly detected, and then can be suitably fed back to the fixing condition based on the detected result.

Second Embodiment

In the description above, the correction of the fixing condition supposing one side printing is carried out by the use of the patch 505 for fixability test printed on one side (front surface) of the paper. However, as another configuration, the correction of the fixing condition supposing double-sided printing may be carried out as described later.

Next, the correction of the fixing condition supposing double-sided printing in a second embodiment of the present disclosure is described with reference to FIG. 6. First, when a user selects a fixability test key corresponding to double-sided printing in the front of the multifunctional peripheral 100, for example, the display receiving unit 301 receives the selection of the fixability test key and the patch forming unit 302 starts the fixability test, and then starts heating of the fixing roller 502 (FIG. 6: S201). Next, the patch forming unit 302 conveys paper from the paper feeding cassette (FIG. 6: S202) and the patch detecting unit 304 detects the characteristic value (background value Gb) of the back surface of the paper using the medium sensor 509 (FIG. 6: S203).

Herein, after the patch detecting unit 304 detects the background value of the paper, the patch forming unit 302 sets the fixing condition of the fixing roller 502 to be equal to or less than the fixing condition set corresponding to execution of the print job when making the paper pass through the fixing roller 502. Specifically, the patch forming unit 302 stops the conveyance of the paper under the detection of the background value Gb by the resist roller 501, and then reduces the fixing temperature (for example, 160° C.) of the fixing roller 502 to a fixing temperature (for example, 80° C.) at standby. Then, the patch forming unit 302 re-starts the conveyance of the paper when the fixing temperature of the fixing roller 502 decreases. Thus, the transmission of an excessive quantity of heat to the paper can be prevented.

Figure 6:
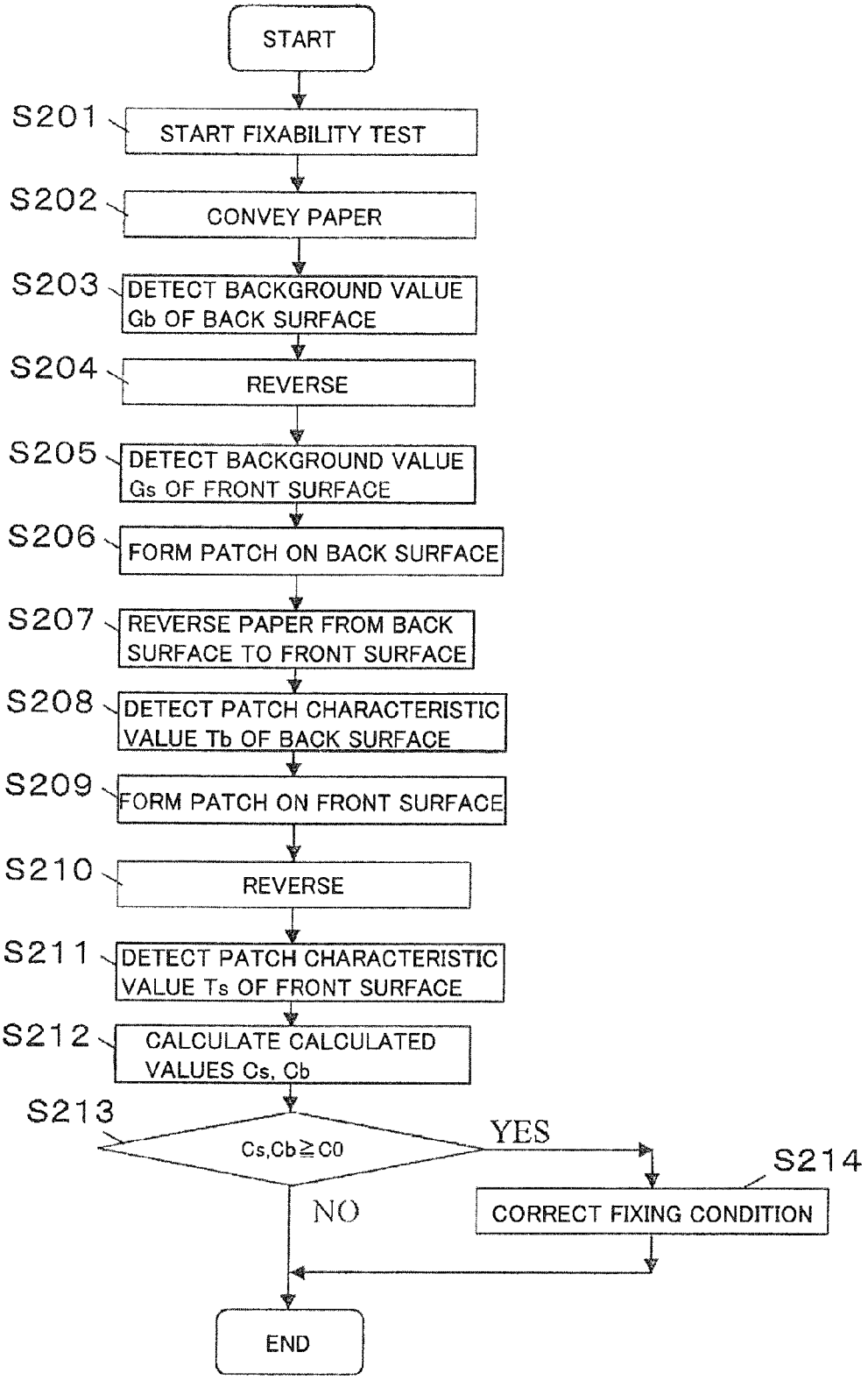
FIG. 6 is a flowchart for showing an execution procedure of a second embodiment of the present disclosure.

When the patch forming unit 302 re-starts the conveyance of the paper, the reversing unit 303 reverses the paper where the background value Gb is detected from the front surface to the back surface, and then re-conveys the reversed paper through the reversing and conveying path 508 (FIG. 6: S204). Then, the paper returns to the resist roller 501 again. Therefore, the patch detecting unit 304 then detects the background value Gs of the front surface of the paper using the medium sensor 509 (FIG. 6: S205). Thus, the background values Gb and Gs of the back surface and the front surface, respectively, of the paper can be detected.

Next, the patch forming unit 302 cancels the stop of the conveyance of the paper by the resist roller 501 under the condition of the fixing roller 502 as the fixing condition, and then forms a patch for fixability test on the back surface of the paper which is conveyed again by the fixing roller 502 (FIG. 6: S206).

Then, the reversing unit 303 reverses the paper on which the patch for fixability test is formed from the back surface to the front surface, and then re-conveys the reversed paper through the reversing and conveying path 508 (FIG. 6: S207). Then, the patch detecting unit 304 detects a characteristic value Tb of the patch for fixability test of the back surface of the paper using the medium sensor 509 (FIG. 6: S208). Furthermore, the patch forming unit 302 forms a patch for fixability test on the front surface of the paper by the fixing roller 502 under the condition of the fixing roller 502 as the fixing condition (FIG. 6: S209).

The reversing unit 303 reverses the paper on which the patch for fixability test is formed from the front surface to the back surface, and then re-conveys the reversed paper through the reversing and conveying path 508 (FIG. 6: S210). Then, the patch detecting unit 304 detects a characteristic value Ts of the patch for fixability test of the front surface of the paper using the medium sensor 509 (FIG. 6: S211). Thus, the characteristic values Tb and Ts of the patch for fixability test of the back surface and the front surface, respectively, of the paper can be detected.

The patch detecting unit 304 discharges the paper and the fixing condition correcting unit 305 calculates a first calculated value Cs obtained by correcting the background value Gs from the characteristic value Ts of the patch for fixability test on the front surface of the paper and calculates a second calculated value Cb obtained by correcting the background value Gb from the characteristic value Tb of the patch for fixability test on the back surface of the paper (FIG. 6: S212). Then, the fixing condition correcting unit 305 corrects the fixing condition based on the first calculated value Cs, the second calculated value Cb, and a threshold value C0 (FIG. 6: S214). Specifically, when the first calculated value Cs exceeds the threshold value C0 or when the second calculated value Cb exceeds the threshold value C0, (FIG. 6: S213 YES), the fixing condition correcting unit 305 corrects the fixing condition (FIG. 6: S214). On the other hand, when the first calculated value Cs is equal to or less than the threshold value R0 or when the second calculated value Cb is equal to or less than the threshold value R0 (FIG. 6: S213 YES), the fixing condition correcting unit 305 completes the processing without correcting the fixing condition.

Third Embodiment

In the description above, the patch for fixability test is formed without considering the front surface state (background state) of paper. However, as another configuration, the fixing condition may be corrected considering the front surface state of paper as described later. For example, in the case of paper to which paper powder adheres or whose front surface state is rough, a surface irregular state varies depending on parts. Herein, when a patch for fixability test is formed at a part having a small surface irregular state, an appropriate background value is acquired. However, when a patch for fixability test is formed at a part having a large surface irregular state, an appropriate background value cannot be acquired and, even when a fixability test is carried out, the correction cannot be performed at an appropriate fixing temperature in some cases.

Then, in the present disclosure, in order to appropriately execute the fixability test even on a rough paper, the front surface state of a part of the paper on which a patch for fixability test is to be formed is checked beforehand. The correction of the fixing condition considering the front surface state of the paper in the third embodiment of the present disclosure is described with reference to FIG. 7.

Figure 7:
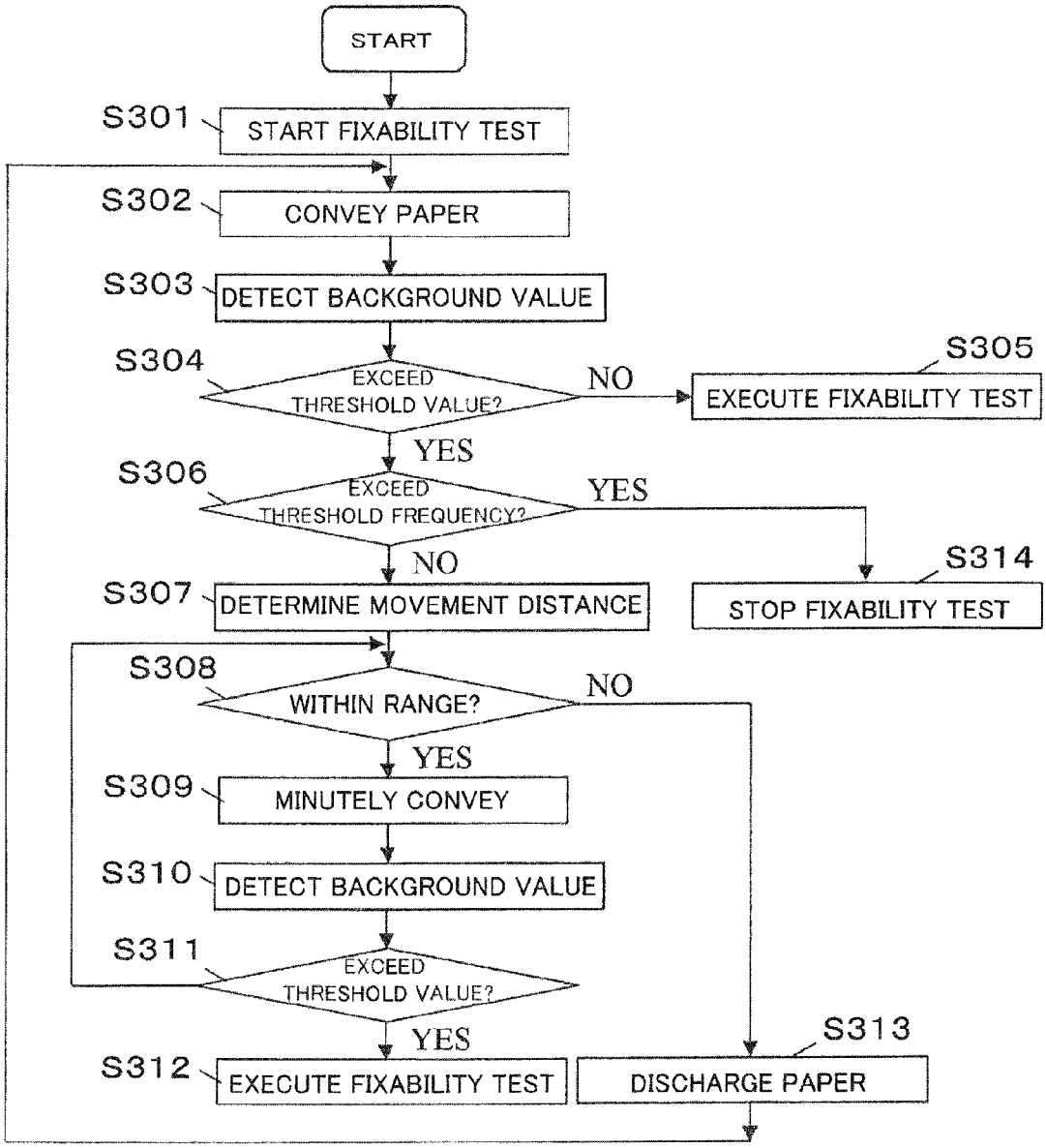
FIG. 7 is a flowchart for showing an execution procedure of a third embodiment of the present disclosure.

First, when a user selects a fixability test key corresponding to one side printing in front of the multifunctional peripheral 100, the display receiving unit 301 receives the selection of the fixability test key and the patch forming unit 302 starts a fixability test, and starts heating of the fixing roller 502 (FIG. 7: S301).

Next, the patch forming unit 302 conveys paper from the paper feeding cassette (FIG. 7: S302). The patch detecting unit 304 temporarily stops the paper by the resist roller 501, and the detects a background value Gb (characteristic value) of the back surface of the paper using the medium sensor 509 (FIG. 7: S303).

Herein, when the patch detecting unit 304 detects the background value Gb of the back surface of the paper, the detection is notified to a state judging unit 306. Then, the state judging unit 306 which receives the notice judges whether or not the detected background value Gb exceeds a preset threshold value (FIG. 7: S304).

Herein, the threshold value is a value corresponding to the irregular state of the front surface of the paper and the background value Gb which exceeds the threshold value indicates that the front surface of the paper has large irregularities. In other words, even when the fixability test is carried out on the front surface of such paper, there is a possibility that the correction cannot be achieved at a suitable fixing temperature.

When the detected background value Gb does not exceed the threshold value as a result of the judgment (FIG. 7: S304 NO), the state judging unit 306 judges that the irregularities of the front surface of the paper are small at the part on which a patch for fixability test is to be formed, and the judgment result is notified to the patch forming unit 302. The patch forming unit 302 which receives the notice executes the fixability test in the same manner as above (FIG. 7: S305).

Specifically, the patch forming unit 302 re-starts the conveyance of the paper and the reversing unit 303 reverses the paper where the background value Gb is detected from the front surface to the back surface, and then re-conveys the reversed paper through the reversing and conveying path 508. Then, the patch forming unit 302 cancels the stop of the conveyance of the paper by the resist roller 501 under the condition of the fixing roller 502 as the fixing condition, and then forms a patch for fixability test on the back surface of the paper which is conveyed again by the fixing roller 502. Then, the reversing unit 303 reverses the paper on which the patch for fixability test is formed from the back surface to the front surface, and then re-conveys the reversed paper through the reversing and conveying path 508. Then, the patch detecting unit 304 detects a characteristic value Tb of the patch for fixability test of the back surface of the paper using the medium sensor 509. The fixing condition correcting unit 305 corrects the fixing condition on the back surface of the paper using the background value Gb and the characteristic value Tb of the patch for fixability test. Thus, the fixability test is appropriately executed.

On the other hand, when the detected background value Gb exceeds the threshold value as a result of the judgment (FIG. 7: S304 YES), the state judging unit 306 judges that the irregularities of the front surface of the paper at a part on which a patch for fixability test is to be formed are large and the judgment result is notified to a frequency judging unit 307. The frequency judging unit 307 which receives the notice judges whether or not the frequency of conveyance of paper for fixability test exceeds a preset threshold frequency (for example, 2 times) (FIG. 7: S306).

For example, the frequency judging unit 307 acquires the frequency (for example, 1 time) of the conveyance of the paper from the patch forming unit 302. At this point, since the frequency of the conveyance of the paper is 1 time, the frequency judging unit 307 judges that the frequency of the conveyance of the paper does not exceed the threshold frequency (FIG. 7: S306 NO), and then notifies the judgment result to a minutely conveying unit 308. The minutely conveying unit 308 which receives the notice moves the part of the paper where the background value Gb is detected within a specific range.

For example, the minutely conveying unit 308 refers to a minute conveyance distance table 800 stored in a specific memory beforehand. As illustrated in FIG. 8, a frequency 801 of the conveyance of the paper, a minute conveyance distance 802 about the movement of the paper, and a movement range 803 of the paper are stored in relation to each other in the minute conveyance distance table 800.

When the frequency 801 becomes higher, the minute conveyance distance 802 becomes shorter, so that the part of the paper is minutely moved. When the frequency 801 becomes higher, the range 803 becomes narrower. The patch for fixability test is a patch of an approximately 1 cm (10 mm)-square shape. Therefore, when the frequency 801 is 1 time, the minute conveyance distance 802 is 2 mm and the range 803 is 10 mm, for example. When the frequency 801 is 2 times, the minute conveyance distance 802 is 1 mm and the range 803 is 5 mm, for example. The range 803 may also be as the frequency of the movement of the minute conveyance distance 802 in place of the distance. For example, when the frequency 801 is 1 time, the minute conveyance distance 802 is 2 mm and the range 803 is 5 times corresponding to the length of 10 mm, for example.

The minutely conveying unit 308 referring to the minute conveyance distance table 800 acquires the minute conveyance distance 802 in which the frequency 801 is 1 time, and then determines the minute conveyance distance 802 (FIG. 7: S307). Then, the minutely conveying unit 308 acquires the range 803 in which the frequency 801 is 1 time, and then judges whether or not the distance in which the paper moves is within the range 803 (FIG. 7: S308).

Herein, since the paper is not yet moved, the minutely conveying unit 308 judges that the distance in which the paper moves is within the range 803 (FIG. 7: S308 YES), and then moves the part of the paper by only the determined minute conveyance distance 802 (FIG. 7: S309).

For example, since the paper is temporarily stopped by the resist roller 501, the minutely conveying unit 308 moves the paper by only the minute conveyance distance by normally or reversely rotating the resist roller 501 by only minute time corresponding to the minute conveyance distance 802.

Then, when the minutely conveying unit 308 completes the movement of the paper, the completion of the movement is notified to the patch detecting unit 304, and then the patch detecting unit 304 which receives the notice re-detects a background value Gb' of the back surface of the paper using the medium sensor 509 (FIG. 7: S310). Thus, when paper powder is accidentally present at the part of the paper where the background value Gb is detected, an appropriate background value Gb' can be searched by moving the part where the background value Gb is detected.

Then, when the patch detecting unit 304 re-detects the background value Gb' of the back surface of the paper, the state judging unit 306 judges whether or not the re-detected background value Gb' exceeds the threshold value in the same manner as above (FIG. 7: S311).

When the re-detected background value Gb' does not exceed the threshold value as a result of the judgment (FIG. 7: S311 NO), the state judging unit 306 judges that a part of the paper in which the irregularities of the surface are small, and then the patch forming unit 302 executes the fixability test in the same manner as above (FIG. 7: S312).

Although the execution procedure of the fixability test is the same as the description above, in the case where the paper is moved by only the minute conveyance distance when acquiring the background value Gb', the minute conveyance distance of the paper is taken into consideration for the formation of the patch for fixability test and the detection of the characteristic value.

Specifically, when the patch forming unit 302 temporarily stops the paper on which the patch for fixability test is to be formed by the resist roller 501, the resist roller 501 is driven for only the minute time to move the paper by only the minute conveyance distance 802 in which the conveyance is executed by the minutely conveying unit 308. Then, the patch forming unit 302 cancels the stop of the conveyance of the paper stop by the resist roller 501, and then forms a patch for fixability test on the back surface of the paper by the fixing roller 502. Thus, the patch for fixability test can be appropriately formed at the part of the paper where the background value Gb' is re-detected.

When the patch detecting unit 304 temporarily stops the paper on which the patch for fixability test is formed by the resist roller 501 to detect the characteristic value Tb of the patch for fixability test using the medium sensor 509, the resist roller 501 is driven for only the minute time to move the paper by only the minute conveyance distance 802 in which the conveyance is executed by the minutely conveying unit 308, and then the medium sensor 509 is started to detect a characteristic value Tb of the patch for fixability test. Thus, the characteristic value Tb of the patch for fixability test at the part of the paper where the background value Gb' is re-detected can be detected On the other hand, when the re-detected background value Gb' exceeds the threshold value as a result of the judgment in S311 (FIG. 7: S311 YES), the state judging unit 306 notifies the judgment result to the minutely conveying unit 308. Then, the process progresses to S308, the minutely conveying unit 308 which receives the notice judges whether or not the distance in which the paper moves is within the range 803 (FIG. 7: S308).

Herein, since the paper is moved only once, the minutely conveying unit 308 judges that the distance in which the paper moves is within the range the range 803 (FIG. 7: S308 YES), and only moves again the part of the paper only by the determined minute conveyance distance 802 (FIG. 7: S309).

On the other hand, when the part of the paper where the background value Gb' is detected is moved two or more times, and then the re-detected background value Gb' is not equal to or less than the threshold value and the distance in which the paper moves is outside the range 803 (FIG. 7: S308 NO), the minutely conveying unit 308 judges that the fixability test on the paper cannot be performed, and then notifies the judgment result to the patch forming unit 302. The patch forming unit 302 which receives the notice discharges the paper (FIG. 7: S313). Thus, a rough paper in which the background value Gb' in any part of the paper is not suitable for the fixability test is discharged.

Then, the process progresses to S302, and then the patch forming unit 302 conveys new paper from the paper feeding cassette (FIG. 7: S302) and the patch detecting unit 304 detects a background value Gb of the back surface of the new paper (FIG. 7: S303). Thus, by changing paper, paper having an appropriate background value Gb can be searched, so that the accuracy of the fixability test can be increased.

When the frequency 801 is 2 times, the minute conveyance distance 802 is 1 mm and the range 803 is 5 mm (5 times). Therefore, the minutely conveying unit 308 more minutely moves the part of the paper where the background value Gb is detected within a narrow range. Thus, on and after the second time of the conveyance of the paper, the time required for searching the background value Gb' can be shortened and the waiting time of a user can be shortened.

On the other hand, when a good background value Gb' cannot be searched even in the paper conveyed at the second time, the following operation is performed. More specifically, the patch forming unit 302 discharges the paper conveyed at the second time in S313 (FIG. 7: S313). In S302, the patch forming unit 302 conveys the third paper from the paper feeding cassette (FIG. 7: S302) and the patch detecting unit 304 detects a background value Gb of the back surface of the third paper (FIG. 7: S303). Herein, even in the case of the third paper, when the detected background value Gb exceeds the threshold value (FIG. 7: S304 YES), the frequency judging unit 307 judges whether or not the frequency (3 times) of the conveyance of the paper for fixability test exceeds the threshold frequency (2 times) (FIG. 7: S306). Since the frequency of the conveyance of the paper exceeds the threshold frequency in the judgment (FIG. 7: S306 YES), the frequency judging unit 307 notifies the judgment result to the patch forming unit 302, and then the patch forming unit 302 which receives the notice stops the fixability test, and then discharges the third paper (FIG. 7: S314). More specifically, in the case of the third paper, when an appropriate background value Gb cannot be acquired in the first measurement, the fixability test is stopped. In this case, since paper stored in the paper feeding cassette of the multifunctional peripheral 100 almost has bad quality, it is judged that carrying out the fixability test is meaningless.

In the third embodiment of the present disclosure, the background value Gb was searched for one side of paper in the case of one side printing but, in the case of double-sided printing, the background value Gb may be similarly searched for both sides of paper.

In the embodiments of the present disclosure, the medium sensor 509 is disposed at a position where the characteristic value of the back surface of paper can be detected but the medium sensor 509 may be disposed at a position where the characteristic value of the front surface of paper can be detected.

The embodiments of the present disclosure have a configuration in which the multifunctional peripheral 100 has the respective units. A storage medium according to another aspect of the present disclosure is a storage medium which stores programs which realize the respective units. In the configuration, the programs are read out by the multifunctional peripheral 100, and then the multifunctional peripheral 100 realizes the respective units. In this case, the programs themselves read out from the storage medium demonstrate the operational effects of the present disclosure. A storage medium according to still another aspect of the present disclosure is a storage medium which stores steps executed by the respective units in a hard disk.

As described above, the image forming apparatus and the image forming method according to the present disclosure are useful for not only a multifunctional peripheral but a scanner, a copying machine, a printer, and the like and are effective as an image forming apparatus and an image forming method capable of correcting a fixing temperature by an existing sensor.

What is claimed is:

1. An image forming apparatus, comprising:

a patch forming unit which forms a patch for fixability test on conveyed paper by a fixing roller having a fixing condition set corresponding to execution of a print job;

a reversing unit which reverses the paper on which the patch for fixability test is formed from a front surface to a back surface, and then re-conveys the reversed paper through a reversing and conveying path;

a medium sensor being disposed on an upstream side of a resist roller which temporarily stops a conveyance of the paper and on a downstream side of the reversing and conveying path in a paper conveying path;

a patch detecting unit which detects a characteristic value of the patch for fixability test of the reversed paper using the medium sensor which detects a characteristic value of the back surface of the paper;

a fixing condition correcting unit which corrects the fixing condition based on the detected characteristic value of the patch for fixability test, a state judging unit which judges whether or not a background value of the paper detected using the medium sensor exceeds a preset threshold value before the patch for fixability test is formed on the paper; and a minutely conveying unit which moves a part of the paper where the background value is detected within a specific range, wherein the patch detecting unit re-detects a background value of the paper using the medium sensor when the part of the paper is moved, the state judging unit judges whether or not the re-detected background value of the paper exceeds the threshold value, and the patch forming unit forms the patch for fixability test on the paper when the re-detected background value does not exceed the threshold value.

2. The image forming apparatus according to claim 1, wherein the patch forming unit forms patches for fixability test on a front surface and a back surface of paper, the reversing unit reverses the paper on which the patch for fixability test is formed from the front surface to the back surface, and then re-conveys the reversed paper through the reversing and conveying path and also, when the patch for fixability test is formed on the back surface of the paper, reverses the paper on which the patch for fixability test is formed from the back surface to the front surface, and then re-conveys the reversed paper, the patch detecting unit detects characteristic values of the patches for fixability test on the front surface and the back surface of the paper using the medium sensor, and the fixing condition correcting unit corrects the fixing condition based on the characteristic values of the patches for fixability test of the front surface and the back surface of the paper.

3. The image forming apparatus according to claim 1, further comprising:

a frequency judging unit which judges whether or not a frequency of the conveyance of the paper on which the patch for fixability test is to be formed exceeds a preset threshold frequency, wherein the minutely conveying unit moves the part of the paper when the frequency of the conveyance of the paper does not exceed the threshold frequency, and the patch forming unit stops a fixability test when the frequency of the conveyance of the paper exceeds the threshold frequency, and then discharges the paper.

4. The image forming apparatus according to claim 3, wherein the minutely conveying unit shortens a minute conveyance distance of the part of the paper to be moved when the frequency of the conveyance of the paper becomes larger.

5. The image forming apparatus according to claim 3, wherein the minutely conveying unit narrows a range in which the part of the paper is moved when the frequency of the conveyance of the paper becomes larger.

6. The image forming apparatus according to claim 4, wherein the minutely conveying unit narrows the range in which the part of the paper is moved when the frequency of the conveyance of the paper becomes larger.

7. An image forming method, comprising:

forming a patch for fixability test on conveyed paper by a fixing roller having a fixing condition set corresponding to execution of a print job;

reversing the paper on which the patch for fixability test is formed from a front surface to a back surface, and then re-conveying the reversed paper through a reversing and conveying path;

detecting a characteristic value of the patch for fixability test of the reversed paper using a medium sensor which detects a characteristic value of the back surface of the paper;

correcting the fixing condition based on the detected characteristic value of the patch for fixability test, judging whether or not a background value of the paper detected using the medium sensor exceeds a preset threshold value before the patch for fixability test is formed on the paper; and minutely conveying a part of the paper where the background value is detected within a specific range, wherein the medium sensor is disposed on an upstream side of a resist roller which temporarily stops a conveyance of the paper and on a downstream side of the reversing and conveying path in a paper conveying path, the detecting re-detects a background value of the paper using the medium sensor when the part of the paper is moved, the judging judges whether or not the re-detected background value of the paper exceeds the threshold value, and the forming forms the patch for fixability test on the paper when the re-detected background value does not exceed the threshold value.

* * * * *